US006514472B2

(12) United States Patent
Menacherry et al.

(10) Patent No.: US 6,514,472 B2
(45) Date of Patent: Feb. 4, 2003

(54) METHOD FOR OPERATION OF A CATALYTIC REACTOR

(75) Inventors: Paul V. Menacherry, New Haven, CT (US); William C. Pfefferle, Madison, CT (US)

(73) Assignee: Precision Combustion, Inc., North Haven, CT (US)

( * ) Notice: Subject to any disclaimer, the term of this patent is extended or adjusted under 35 U.S.C. 154(b) by 126 days.

(21) Appl. No.: 09/793,834

(22) Filed: Feb. 26, 2001

(65) Prior Publication Data

US 2002/0119087 A1 Aug. 29, 2002

(51) Int. Cl.[7] ..... C01K 1/00; C01B 31/20
(52) U.S. Cl. ..... 423/246; 423/437.2
(58) Field of Search ..... 423/246, 437.2

(56) References Cited

U.S. PATENT DOCUMENTS 5,271,916 A * 12/1993 Vanderborgh et al. ..... 422/177
5,518,705 A * 5/1996 Buswell et al. ..... 423/247
6,290,913 B1 * 9/2001 Aoyama ..... 422/108
6,309,768 B1 * 10/2001 Patterson et al. ..... 423/437.1
6,332,901 B1 * 12/2001 Nagamiya et al. ..... 422/105

* cited by examiner

*Primary Examiner*—Stanley S. Silverman
*Assistant Examiner*—Maribel Medina
(74) *Attorney, Agent, or Firm*—McCormick, Paulding & Huber LLP

(57) ABSTRACT

A method for the selective oxidation of carbon monoxide in a gas stream comprising carbon monoxide, hydrogen and oxygen in an adiabatically operated fixed-bed, catalytic reactor. In the method the inlet temperature is controlled based upon the space velocity of the gas stream through the reactor.

4 Claims, 3 Drawing Sheets

METHOD FOR OPERATION OF A CATALYTIC REACTOR

FIELD OF THE INVENTION

The present invention relates to a method for the selective oxidation of carbon monoxide (CO) in gas streams comprising carbon monoxide, hydrogen and oxygen. More specifically the invention relates to the method of operation of fixed-bed catalytic reactors operating adiabatically to reduce the degree of the reverse water gas shift reaction that can occur in selective oxidation reactors.

BACKGROUND OF THE INVENTION

Hydrogen is becoming an increasingly desired fuel. One method of obtaining hydrogen is to release it from hydrocarbons. This approach suffers from the simultaneous production of carbon monoxide. Hydrogen containing carbon monoxide impairs the performance of many systems such as ammonia synthesis reactors and low temperature fuel cells. It is therefore desirable to have mechanisms to remove carbon monoxide from hydrogen. One method of accomplishing this removal is the selective oxidation of the carbon monoxide using a fixed-bed catalytic reactor.

Catalytic reactors of the fixed-bed type to selectively oxidize carbon monoxide are well known in the art. It is also well known that these fixed-bed reactors when operated for the selective oxidation of CO under varying flow conditions, such as reduced load conditions in fuel processing for fuel cell applications, can actually produce carbon monoxide via the reverse water gas shift reaction, the reaction occurring when the oxygen concentration within the bed is depleted below a minimum threshold value. Thus if oxygen is consumed to this minimal threshold value before the hydrogen containing gas stream exits the catalyst bed, carbon monoxide is reformed in the oxygen depleted zone of the reactor. Addition of additional oxygen into the oxygen depleted zone of the reactor, as proposed in U.S. Pat. No. 5,811,692, prevents the reverse water gas shift reaction but at the expense of additional hydrogen consumption and added operational complexity.

SUMMARY OF THE INVENTION

It has now been found that the reverse water gas shift reaction within a fixed-bed, catalytic reactor for the selective oxidation of carbon monoxide can be controlled for a broad range of operating conditions, flow rates, by controlling critical input parameters of the gas stream entering the reactor.

In the present application, an adiabatic reactor is defined as a reactor having no active heat removal device but which may have normal cooling losses associated typically with such reactors. In such a reactor, a temperature rise is observed typically along the length of the reactor for exothermic reactions, such as CO oxidation.

It has been found that in an adiabatically operated fixed-bed, catalytic reactor that the inlet temperature of the entering gas stream, and space velocity of the gas stream in the reactor are determinative of when and to what degree the reverse water gas shift reaction, if at all, will occur within the catalytic reactor. In essence, when the space velocity is changed due to a change in flow rate, such as during partial load operation, adjustments in the inlet temperature of the gas stream can be used to alter the carbon monoxide formation resulting from the reverse water gas shift reaction.

Under some circumstances, it might be possible to eliminate entirely the reverse water gas shift reaction and the CO production therefrom.

DETAILED DESCRIPTION OF THE INVENTION

Figure 1:
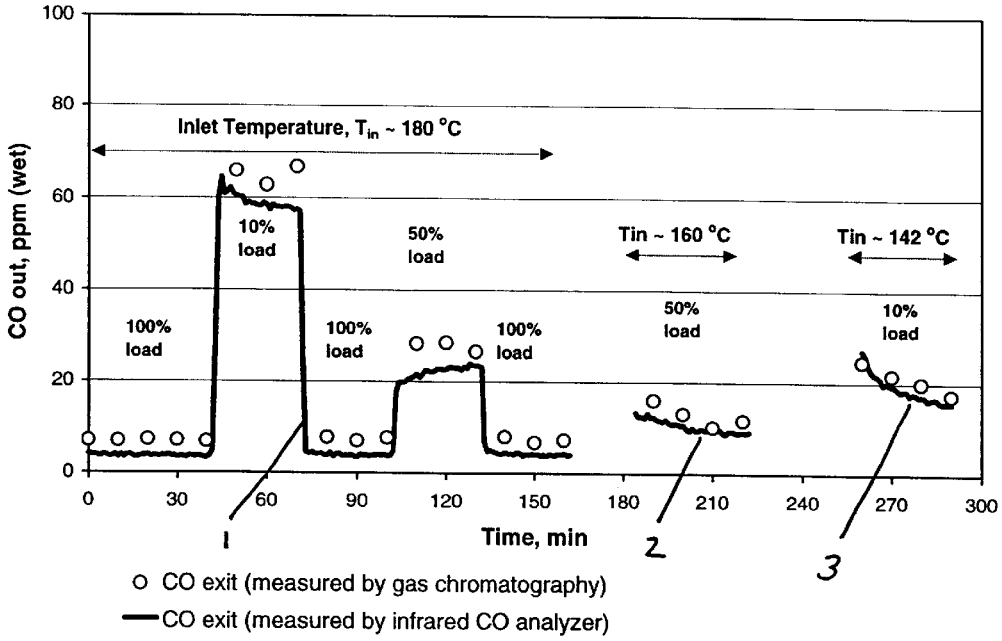
FIG. 1 is a graphic presentation of test results obtained for the selective oxidation of carbon monoxide in a hydrogen rich gas stream at various flow rates. The flow rates are representative of different load conditions in a variable throughput fuel processing application.

FIG. 1 contains three plots depicting the carbon monoxide concentration out of a fixed-bed, catalytic reactor operating adiabatically, in parts per million (ppm) wet. The plots are based on a fixed-bed catalytic reactor operating with a gas stream having an oxygen stoichiometry lambda (defined as the ratio of two times (based on molar concentration) the oxygen to CO on the gas stream) of 8.0. The three plots are based on a constant gas stream composition but at three different inlet temperatures 180 degrees C., 1, 160 degrees C, 2, and 142 degrees C., 3.

As shown in the 180 degree C. temperature inlet plot 1, as load, flow rate, is changed the CO out increases. At 10% load CO out has increased from about 5 ppm to just under 60 ppm. At 50% load just over 20 ppm CO out is being produced. As shown in the 160 degree plot, however, CO out for the same gas stream composition at 50% load can be reduced to the low teens if the inlet temperature is changed from 180 degrees C. to 160 degrees C. As shown in the 142 degree C. plot 3, the result for a 10% load is even more dramatic. When the inlet temperature is changed from 180 degrees C. to 142 degrees C., the CO out is reduced from around 60 ppm to around 20 ppm.

Figure 2:
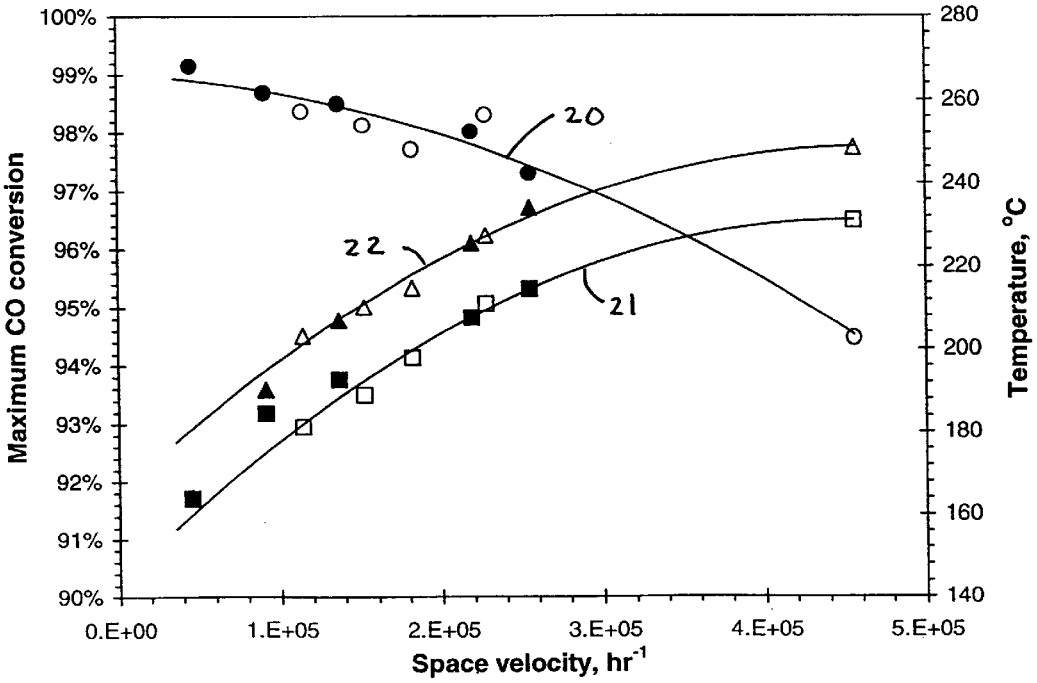
FIG. 2 is a graphic representation of the maximum achievable CO conversion and the inlet and exit gas temperature corresponding to maximum CO conversion as a function of space velocity for a representative specific reactor design.

FIG. 2 is a characteristic plot for a specific fixed-bed catalytic reactor correlating Maximum CO Conversion and Temperature to Space Velocity. The reactor is operated adiabatically, no heat of reaction is removed from the bed. The three specific plots are the maximum CO conversion 20, the inlet temperature 21 and the exit temperature 22. As used in this plot, space velocity is the resulting quotient of the volumetric flow rate (defined at standard temperature=25 degrees C. and pressure=1 atm) divided by the volume of the reactor. Space velocity is independent of the characteristics of the catalyst within the reactor, therefore, this characteristic plot is for a specific catalyst structure. The characteristic plot in FIG. 2 is for a gas composition containing 800 ppm of CO with sufficient oxygen to give a lambda of 4 and contains in addition $CO_2$=13.89%, $H_2$=31.96%, $H_2O$=32.88%, and $N_2$ balance.

As an example, the characteristic plot indicates that for a space velocity equal to 2.E+05 to achieve the maximum conversion of carbon monoxide, which is approximately 98%, an inlet temperature of approximately 204 degrees C. is required yielding an exit temperature of approximately 222 degrees C. In this example, the exit temperature represents the adiabatic temperature of the gas stream. Thus the reactor maximum temperature is the adiabatic temperature, and the reactor maximum temperature occurs coincidentally with the reactor exit; the reactor is producing the minimum CO possible. The ability to adjust the inlet temperature to coincide achieving the adiabatic temperature with the reactor exit is not a practical measure of optimum reactor operation, therefore for this invention minimum CO concentrations, or optimum catalytic reactor operation for the oxidation of carbon monoxide, is achieved when a reactor maximum temperature is approximately equal to the adiabatic temperature of the gas stream occurs proximate to the reactor exit, either the maximum reactor temperature is just below, or equal to, the adiabatic temperature.

Reactor operation at a space velocity of 2.E+05 at any other gas stream inlet temperature will produce an effluent containing more CO. Where the inlet temperature is below the indicated temperature, the loss in CO conversion will result due to the failure of the catalytic reactor to fully convert the CO and reach the adiabatic temperature. Where the inlet temperature exceeds the indicated temperature, the loss in CO conversion will result due to the reverse water gas shift reaction. In other words, the reactor maximum temperature will equal the adiabatic temperature at a point prior to the reactor exit.

Figure 3:
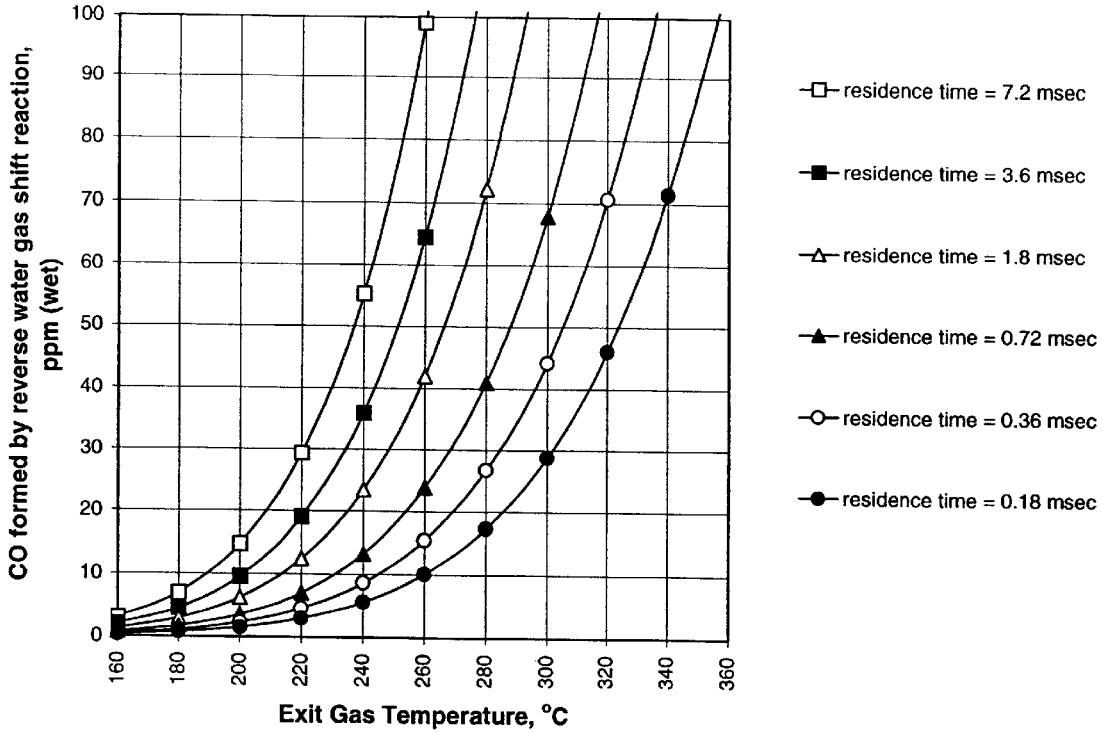
FIG. 3 is a family of curves for Exit gas Temperature (adiabatic temperature) versus the calculated amount of CO formed by reverse water gas shift for a fixed inlet gas composition for different residence times in the oxygen depleted region.

The effect of reaching the adiabatic temperature prior to the exit of the reactor is demonstrated in FIG. 3. FIG. 3 is a plot of CO formed in ppm (wet) versus Exit Gas Temperature in degrees C. at ever increasing residence times within the oxygen depleted zone. In other words, the residence time is the time in milliseconds that the gas stream remains within the reactor after achieving the adiabatic temperature. The detrimental effect of increased CO concentration in the effluent resulting from the reverse water gas shift reaction that occurs due to reaching the adiabatic temperature prior to the end of the reactor can be seen in the following example. For a in inlet gas stream of a given composition, if the adiabatic temperature is 220 degrees C., and this temperature is reached 7.2 msec prior to the gas stream exiting the reactor the effluent gas stream will contain at least 30 ppm (wet) of carbon monoxide due to the reverse water gas shift reaction.

As stated above, FIG. 2 is a characteristic plot of a specifically designed fixed-bed, catalytic reactor. Therefore if the catalytic reactor is changed (such as catalyst or support structure, pressure drop), the characteristic plot will change. In fact, FIG. 2 is but one curve of a family of curves for this specifically designed fixed-bed, catalytic reactor. To determine the optimum operational characteristics of a given catalytic reactor, multiple curves at different CO concentrations and lambda values are required.

Figure 4:
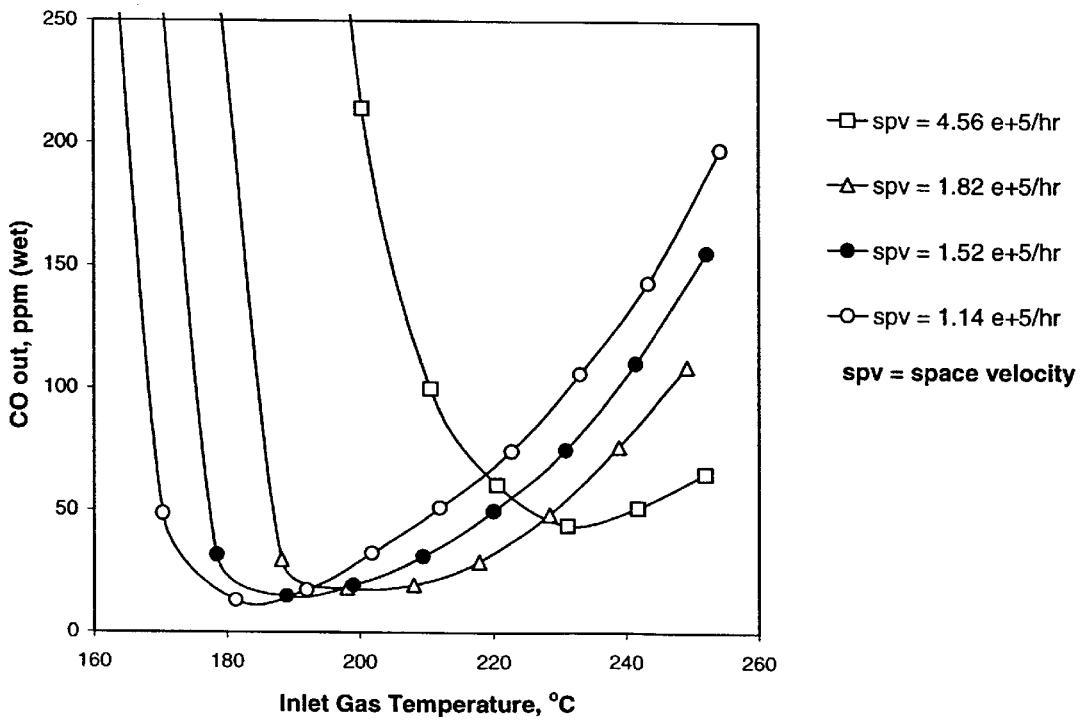
FIG. 4 is a graphic presentation of test results of inlet gas temperature versus CO out for a fixed inlet gas composition for different reactor space velocities.

A method for determining the characteristic space velocity-conversion-optimum inlet temperature relationship for a given gas composition comprises experimentally determining the CO conversion versus inlet temperature for each space velocity of interest to determine the maximum achievable CO conversion and the corresponding inlet gas temperature. A graphic representation of the data from such a study is shown in FIG. 4. The space velocity dependence of maximum conversion and optimum inlet gas temperature for any gas composition of interest can be similarly determined.

The fixed-bed, catalytic reactor employed was constructed of a plurality of short-channel, expanded metal supports with platinum supported on alpha alumina thereon. The invention however, does not require this specific reactor design. As an example, other support structures such as monoliths, foams, and pellets could be used as well as other precious metals such as rhodium or palladium. Relevant lambda values are based upon the selectivity of the catalyst related to carbon monoxide. It should also be keep in mind that inlet temperature may be related to catalyst light-off, therefore low required inlet temperatures could cause light-off difficulties.

Figure 5:
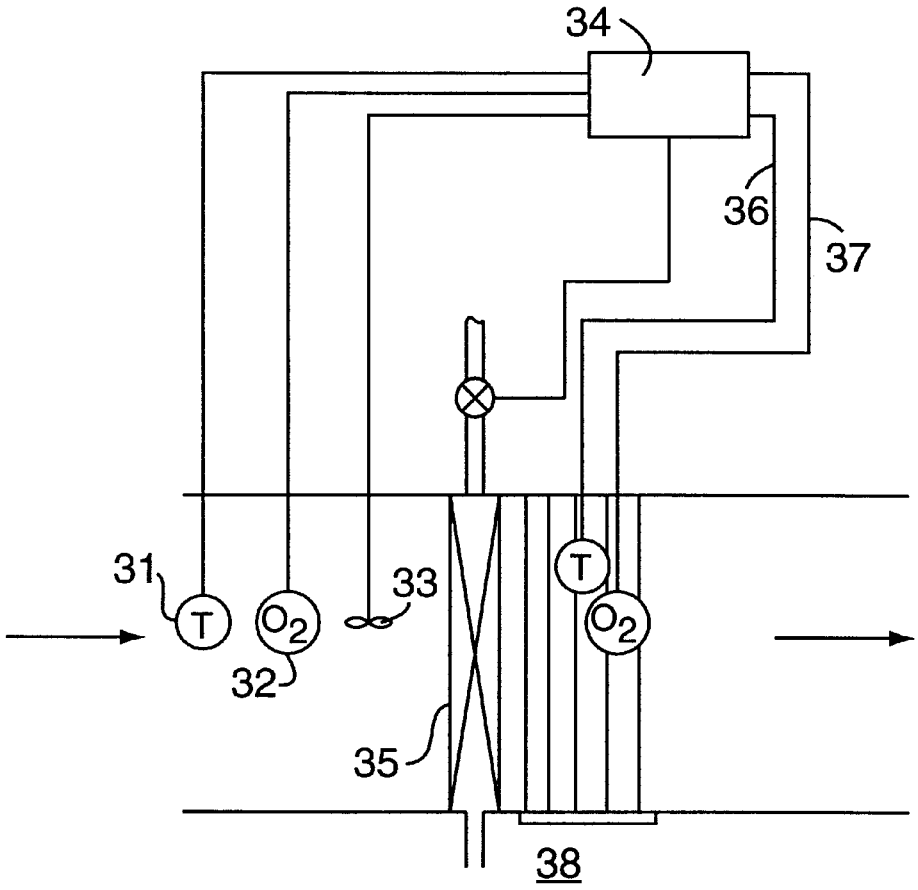
FIG. 5 is a representation of a catalytic reactor and control mechanism to perform the present invention.

FIG. 5 is an apparatus for implementing the present method. In the apparatus a temperature sensor 31, an oxygen sensor 32, and a flow sensor 33, are positioned in the gas stream. The sensors are connected to a general programmable computer 34. The computer 34 is programmed to determine based upon the input from the flow sensor the space velocity of gas stream through the catalyst reactor 38. Based on a predetermined set of characteristic curves, the computer determines an inlet temperature. The computer 34 then determines the temperature delta between the first temperature determined by temperature sensor 31 and the required inlet temperature. Then by a heat exchanger 35, controlled by outputs from the computer 34, the temperature of the gas stream is adjusted to the proper inlet temperature.

Optional oxygen sensor(s) 36 and/or temperature sensor (s) 37 could be used to provide data to computer 34 as part of a feedback control system. The feedback control system would allow for minor adjustments in gas stream input temperature by monitoring such events as whether the adiabatic temperature is being reached prior to the end of the bed. The feedback control system would account for any changes in the operational characteristics of the fixed-bed catalytic reactor.

What is claimed is:

1. The method of selectively oxidizing carbon monoxide in a gas stream comprising carbon monoxide, hydrogen and oxygen within an adiabatically-operated, fixed-bed catalytic reactor having a catalyst suitable for promoting oxidation of the carbon monoxide and an exit, the method comprising:

determining a flow rate, an oxygen concentration, a carbon monoxide concentration, and a first temperature of the gas stream, determining based upon the flow rate a space velocity of the gas stream through the catalytic reactor, determining based upon the space velocity, the oxygen concentration, the carbon monoxide concentration and the catalyst an inlet temperature and an maximum reactor temperature, and adjusting the temperature of the gas stream from the first temperature to the inlet temperature.

2. The method of claim 1 wherein the inlet temperature is controlled such that the reactor maximum temperature is approximately equal to the adiabatic temperature, the reactor maximum temperature occurring proximate to the reactor exit.

3. The method of selectively oxidizing carbon monoxide in a gas stream comprising carbon monoxide, hydrogen and oxygen, the gas stream having an inlet temperature and an adiabatic temperature, within an adiabatically-operated, fixed-bed catalytic reactor having a catalyst suitable for promoting oxidation of carbon monoxide and an exit, the reactor capable of cooperating with the gas stream to achieve a space velocity, the method comprising:

adjusting the inlet temperature as a function of the space velocity.

4. The method of claim 3 wherein the inlet temperature is controlled such that the reactor maximum temperature is approximately equal to the adiabatic temperature, and the reactor maximum temperature occurs proximate to the reactor exit.

* * * * *

UNITED STATES PATENT AND TRADEMARK OFFICE

CERTIFICATE OF CORRECTION

PATENT NO. : 6,514,472 B2
DATED : February 4, 2003
INVENTOR(S) : Paul V. Menacherry et al.

It is certified that error appears in the above-identified patent and that said Letters Patent is hereby corrected as shown below:

Column 1,
Line 14, before BACKGROUND OF THE INVENTION please insert;

-- GOVERNMENT RIGHTS
This invention was made with U.S. government support under DMI-0060771 awarded by the National Science Foundation. The U.S. government has certain rights in this invention. --

Signed and Sealed this

Sixth Day of May, 2003

JAMES E. ROGAN
*Director of the United States Patent and Trademark Office*